US012269657B2

(12) United States Patent
Downing et al.

(10) Patent No.: US 12,269,657 B2
(45) Date of Patent: Apr. 8, 2025

(54) BEVERAGE CAN WITH INGREDIENT CHAMBER

(71) Applicant: PepsiCo, Inc., Purchase, NY (US)

(72) Inventors: Graham Robert Downing, Chicago, IL (US); Bruno Telesca, Sandy Hook, CT (US); Andrew Robert Taylor, Cambridge (GB); Leanne Yip Heung Win, Cambridge (GB)

(73) Assignee: PepsiCo, Inc., Purchase, NY (US)

( * ) Notice: Subject to any disclaimer, the term of this patent is extended or adjusted under 35 U.S.C. 154(b) by 296 days.

(21) Appl. No.: 17/710,672

(22) Filed: Mar. 31, 2022

(65) Prior Publication Data

US 2023/0312196 A1 Oct. 5, 2023

(51) Int. Cl.
*B65D 51/28* (2006.01)
*B65D 17/34* (2006.01)
*B65D 81/32* (2006.01)

(52) U.S. Cl.
CPC ..... *B65D 51/2828* (2013.01); *B65D 17/34* (2018.01); *B65D 81/3233* (2013.01)

(58) Field of Classification Search
CPC . B65D 51/2828; B65D 17/34; B65D 81/3233
USPC ..... 426/115
See application file for complete search history.

(56) References Cited

U.S. PATENT DOCUMENTS

| | | | | |
|---|---|---|---|---|
| 3,779,372 | A | 12/1973 | de Lloret | |
| 4,333,581 | A | 6/1982 | Flansburg | |
| 5,290,574 | A | 3/1994 | Jamieson et al. | |
| 5,711,420 | A | 1/1998 | Spring | |
| 5,885,635 | A | 3/1999 | Spring et al. | |
| 10,392,178 | B2 | 8/2019 | Byun et al. | |
| 2013/0087472 | A1* | 4/2013 | Pradeep | B65D 25/08 206/219 |
| 2023/0105236 | A1 | 4/2023 | Hendrix | |

OTHER PUBLICATIONS

International Search Report and Written Opinion in counterpart International Application No. PCT/US2023/016555, mailed on Jul. 28, 2023, 9 pages.

* cited by examiner

*Primary Examiner* — Brent T O'Hern
(74) *Attorney, Agent, or Firm* — Sterne, Kessler, Goldstein & Fox P.L.L.C.

(57) ABSTRACT

A beverage can with an ingredient chamber for storing functional ingredients separately from a base beverage until the beverage can is opened by a consumer. The ingredient chamber may be disposed on a can end of the beverage can. The ingredient chamber may be broken open to release functional ingredients automatically when the beverage can is opened by the consumer. In some embodiments, the ingredient chamber includes a membrane that forms a sealed cavity. In some embodiments, the ingredient chamber includes a deformed cavity of the can end.

22 Claims, 12 Drawing Sheets

BEVERAGE CAN WITH INGREDIENT CHAMBER

FIELD

This disclosure generally relates to beverage cans. More specifically, some embodiments relate to metal beverage cans and beverage can ends with ingredient chambers.

BACKGROUND

As functional beverages and ingredients gain popularity among consumers, it becomes desirable to create ready-to-drink beverages (RTD) with functional ingredients. However, some functional ingredients are unstable and sensitive to the environment, so their functionality may degrade within a short period after interaction with other ingredients of the beverage.

SUMMARY

In some embodiments, the beverage can end includes a metal body, wherein the metal body has a weakened portion configured to be broken open to create a drinking opening. A tab is disposed on a topside of the metal body, configured to be actuated to break open the weakened portion. An ingredient chamber is disposed on an underside of the metal body. The ingredient chamber includes a sealed membrane containing a beverage ingredient.

In some embodiments, the beverage can end includes a metal body, wherein the metal body has a break-away flange that creates a drinking opening through the metal body when broken away from the rest of the metal body. The metal body defines a cavity with an opening on an underside of the metal body. The cavity may store a beverage ingredient. A tab is disposed on a topside of the metal body. The tab may be actuated to apply force to the break-away flange to break the break-away flange away from the rest of the metal body.

BRIEF DESCRIPTION OF THE FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

DETAILED DESCRIPTION

Figure 1:
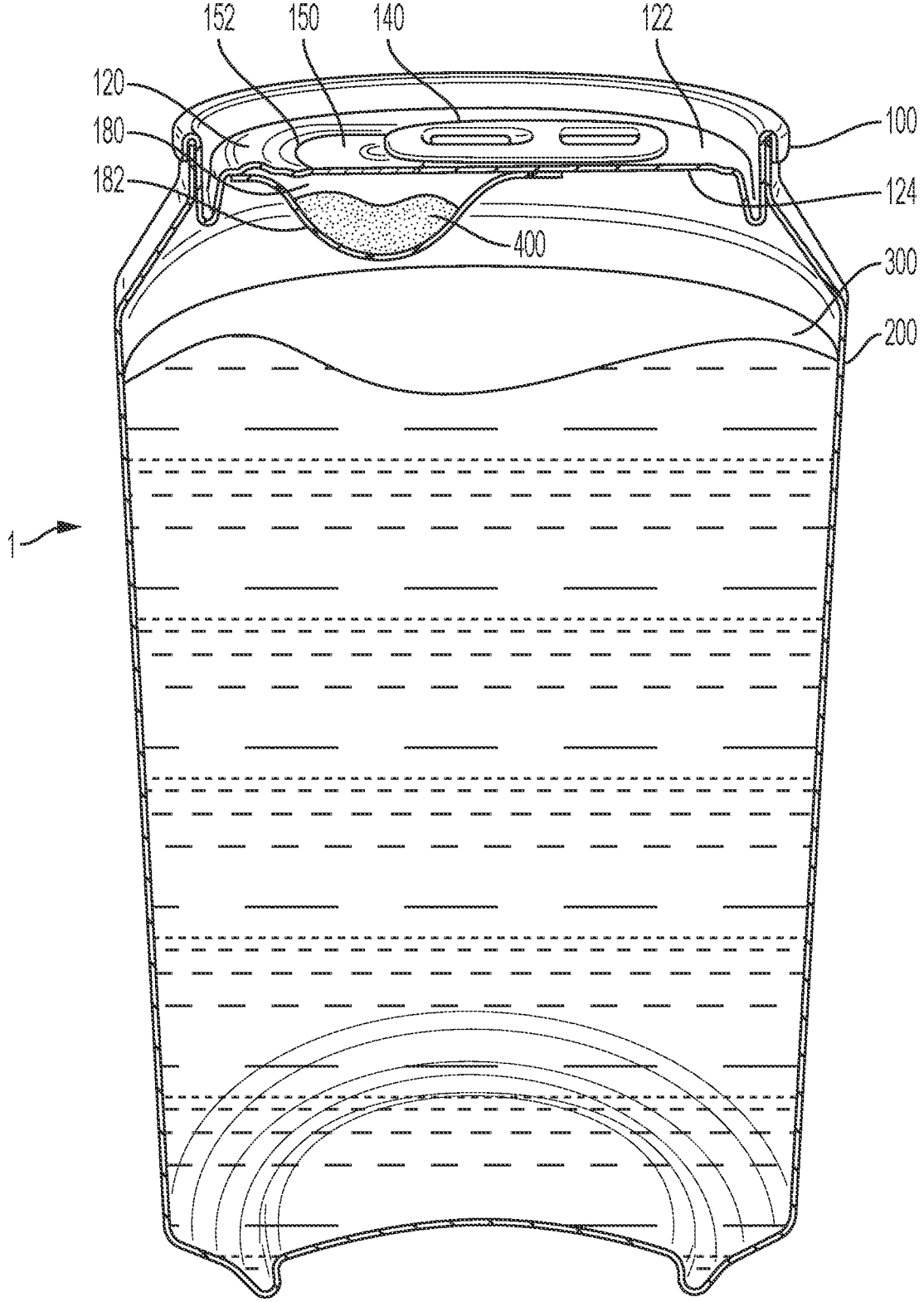
FIG. 1 is a side sectional view of a beverage can with an ingredient chamber.

The present invention(s) will now be described in detail with reference to embodiments thereof as illustrated in the accompanying drawings. References to "one embodiment," "an embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Functional food and ingredients have potential benefits to health and wellness. Examples of such functional ingredients include vitamins, probiotics, creatine, ginseng, citicoline, and tart cherry. However, it sometimes is difficult or unpalatable to directly consume those functional ingredients because of their taste or mouthfeel. In order to help the intake of an effective amount of functional ingredients, one way to consume functional ingredients is to mix them with a flavored beverage to make a functional beverage.

As such functional beverages become popular among consumers, it is desirable to store functional beverages in traditional beverage packaging, such as beverage cans. Traditional beverage packaging provides processing efficiency, storage and transportation efficiency, and longer shelf life of the product. It therefore helps to bring functional ingredients and functional beverages to the market on a mass production scale.

However, traditional beverage packaging generally allows for only a single homogenous solution to be stored, and traditionally-packaged beverages are filled and sealed long before reaching a consumer.

Functional ingredients, on the other hand, are sometimes unstable and sensitive to the environment, and the efficacy of their claimed benefits may degrade within a short period after dissolved in another ingredient, such as an acidic solution. For example, vitamin C, probiotics, and aspartame are known to degrade in an acidic solution (pH<7). In many cases, in order to preserve high (e.g., maximum) efficacy of the claimed benefits, it is desirable to mix functional ingredients with the rest of the beverage immediately before consumption.

As a result, since traditional beverage packaging stores functional ingredient with the rest of the beverage as a single homogenous solution long before reaching a consumer, traditional beverage packaging may not be ideal for delivering functional ingredients effectively to consumers.

In order to effectively deliver functional beverages in traditional beverage packaging, there is a benefit to storing them separately from other ingredients of the beverage, to be mixed shortly before consumption. And to efficiently deliver functional beverages to consumers, there is a benefit to leveraging traditional beverage cans. In some embodiments described herein, a sealed ingredient chamber is provided underneath a can end for separately storing the functional ingredients. In some other embodiments, a can end is deformed to create a cavity that can be sealed to form an ingredient chamber for separately storing the functional ingredients. In either case, the sealed ingredient chamber is broken open when the can is opened by a consumer, at that point releasing functional ingredients from the ingredient chamber into the rest of the beverage stored in the can. In this way, a traditional can form can be used to efficiently store and deliver a functional beverage to a consumer, while maintaining the functional ingredients separate from the rest of the beverage until the can is opened by the consumer in order to preserve high (e.g., maximum) efficacy of the claimed benefits.

Embodiments described herein thus provide a separate storage for functional ingredients with minimal modification to consumer behavior. In some embodiments described herein, the separate storage for functional ingredients is provided underneath the drinking opening of the can end, such that it is broken open automatically with a traditional stay-on tab lever mechanism. This provides a separate storage for functional ingredients without requiring the consumer to perform a separate additional step of breaking open and releasing the functional ingredients before consuming the beverage. Because the mechanism for breaking open and releasing the functional ingredients does not involve deviation from current consumer behavior for opening a traditional can, there is little-to-no risk that consumers would forget to or unsuccessfully release the functional ingredient—it happens automatically upon opening.

In order to leverage the efficiencies and established process of existing can and can end manufacturing, it can be beneficial to minimize disruption attendant to adding steps or processes in the manufacturing process. Therefore, according to some embodiments described herein, the separate storage for functional ingredients can be formed in a traditional can end through a simple and quick process, or can be formed as a separate self-contained sealed cavity, manufactured independently from the can end, and attached to the can end after the can end is has been manufactured.

Figure 5:
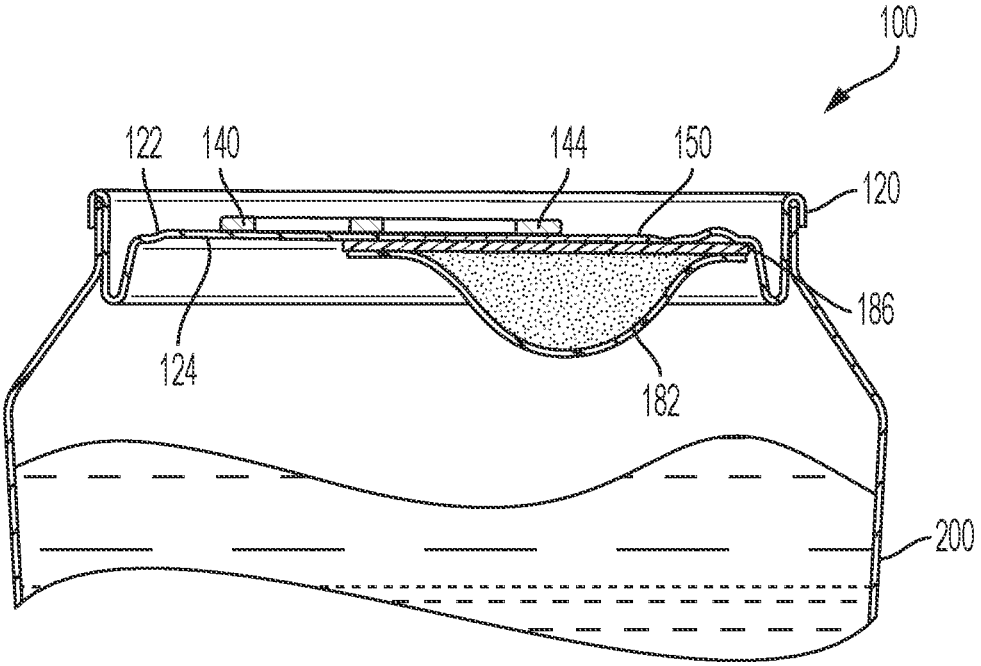
FIG. 5 is a schematic side view of a can end with a self-contained ingredient chamber.

A beverage can 1 as shown in FIG. 1 includes a can end 100 and a can body 200, which together define a sealed cavity for storing beverages. A base beverage 300 may be stored inside can body 200. Can end 100 has a metal body 120 with a topside 122 and an underside 124. According to one embodiment, an ingredient chamber 180 is created by a membrane 182 disposed on underside 124 of metal body 120 for storing a beverage ingredient 400, such as a functional ingredient, separately from base beverage 300. Membrane 182 may be disposed on underside 124 through an adhesive material. Membrane 182 may be attached directly to underside 124 to create a sealed cavity for beverage ingredient 400. Alternatively, membrane 182 may be attached to a top layer 186 to create a sealed cavity for beverage ingredient 400, and top layer 186 is then attached to underside 124, as shown in FIG. 5.

Figure 2:
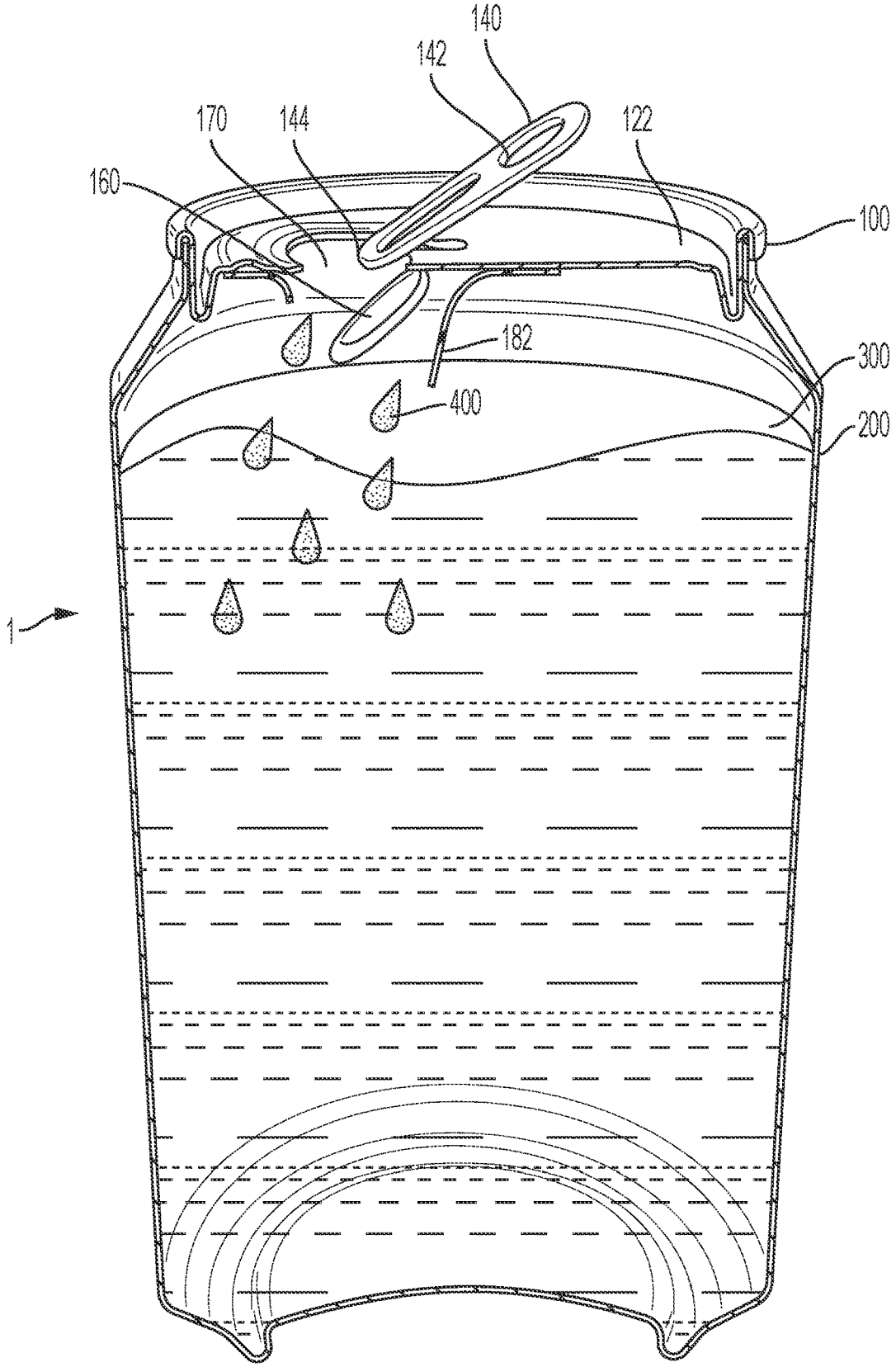
FIG. 2 is a side sectional view of the beverage can of FIG. 1 with the ingredient chamber broken open.

Membrane 182 may be made of a material breakable under a pressure exerted by a flange 160 when an opening 170 is created, as shown in FIG. 2. Membrane 182 may also be made of a material that does not chemically interact with beverage ingredient 400 or base beverage 300. For example, membrane 182 may be made of a polymer or metal, such PVC, PE, nylon, or aluminum. Membrane 182 may be homogeneous or made of a combination of materials (e.g., in a form of laminated multi-layer films).

Ingredient chamber 180 formed by membrane 182 may have a capacity between 0.1 cc and 65 cc, (e.g., between 0.1 cc and 3 cc, between 1 cc and 3 cc, between 7 cc and 9 cc, or between 55 cc and 65 cc). In some embodiments, such capacities may pertain to a 12-fluid-oz beverage can 1. However, the capacity of ingredient chamber 180 may be proportional to the capacity of beverage can 1. For example, ingredient chamber 180 may have a capacity between 0.03% and 18% of the capacity of beverage can 1 (e.g., between 0.03% and 0.8% of the capacity of beverage can 1, between 0.3% and 0.8% of the capacity of beverage can 1, between 2% and 2.5% of the capacity of beverage can 1, or between 15% and 18% of the capacity of beverage can 1). For example, smaller capacities may be used for ingredients that are effective in smaller amounts (e.g., orange essence in a chamber having a capacity between 0.1 cc and 3 cc, or between 0.03% and 0.8% of the capacity of the beverage can), moderate capacities may be used for ingredients that are effective in moderate amounts (e.g., creatine in a chamber having a capacity between 7 cc and 9 cc, or between 2% and 2.5% of the capacity of the beverage can), and larger capacities may be used for ingredients that are effective in larger amounts (e.g., protein in a chamber having a capacity between 55 cc and 65 cc, or between 15% and 18% of the capacity of the beverage can).

Figure 4:
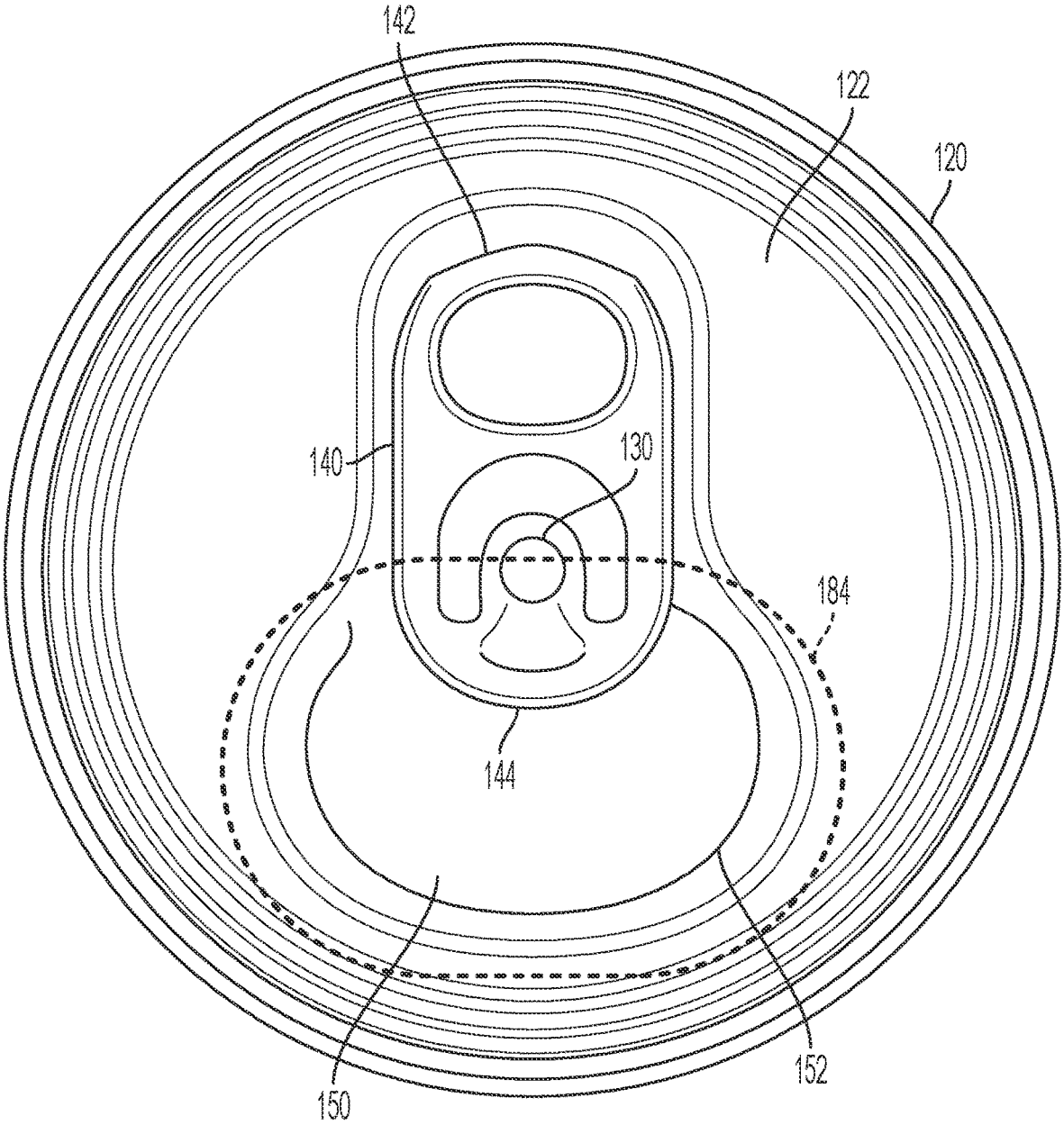
FIG. 4 is a schematic top view of the can end of FIGS. 3A-3C.

On topside 122 of metal body 120, as shown in the top view of FIG. 4, a weakened portion 150 is defined by a weakened line 152 and is configured to be broken away from the rest of metal body 120 along weakened line 152. Additionally, a tab 140 is disposed on topside 122 and connected to metal body 120 by a rivet 130. Tab 140 has a ring 142 and a tab end 144 on opposite ends, and tab end 144 is located above weakened portion 150.

FIG. 2 shows beverage can 1 after opened by a consumer. After weakened portion 150 breaks away from the rest of metal body 120, a flange 160 is created from weakened portion 150, bending downwards from metal body 120, and a drinking opening 170 is created on metal body 120. Ingredient chamber 180 may be located under weakened portion 150 and disposed across weakened portion 150, such that at the same time weakened portion 150 breaks away from metal body 120 to create drinking opening 170, flange 160 breaks membrane 182 automatically to release beverage ingredient 400 from ingredient chamber 180.

Figure 3A:
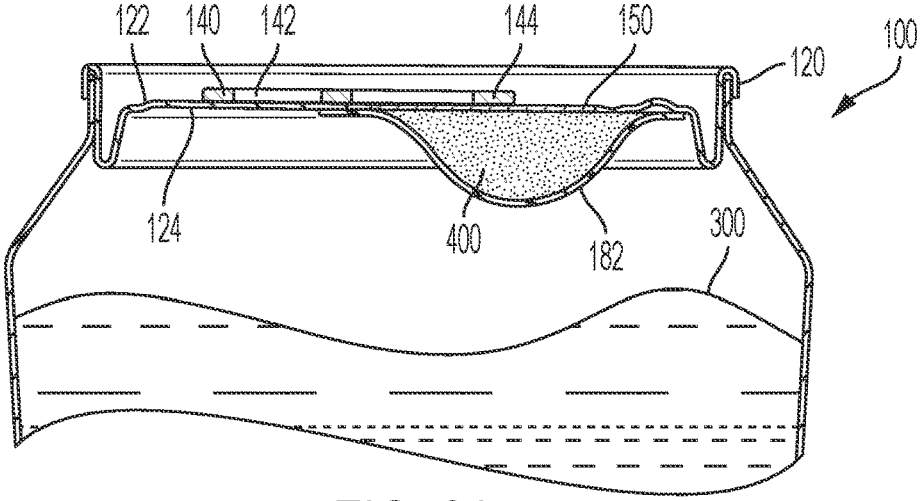
FIGS. 3A-3C are schematic side views of a can end with an ingredient chamber, showing different stages of opening.
Figure 3B:
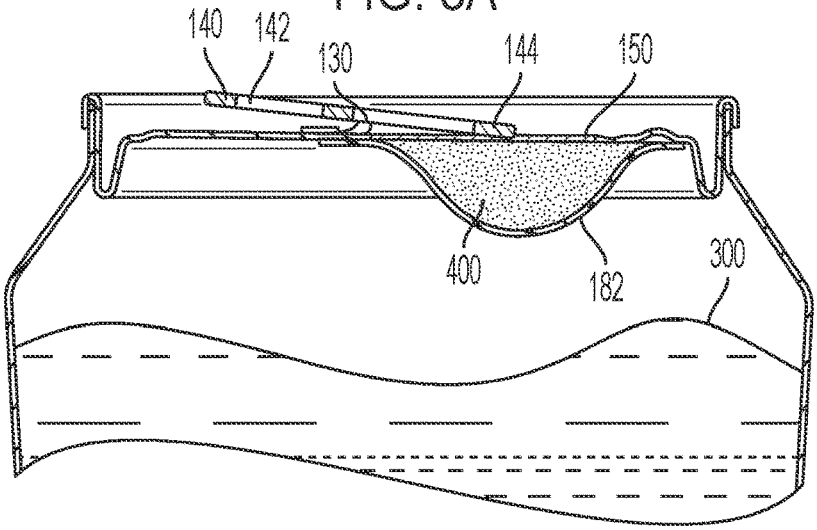
Figure 3C:
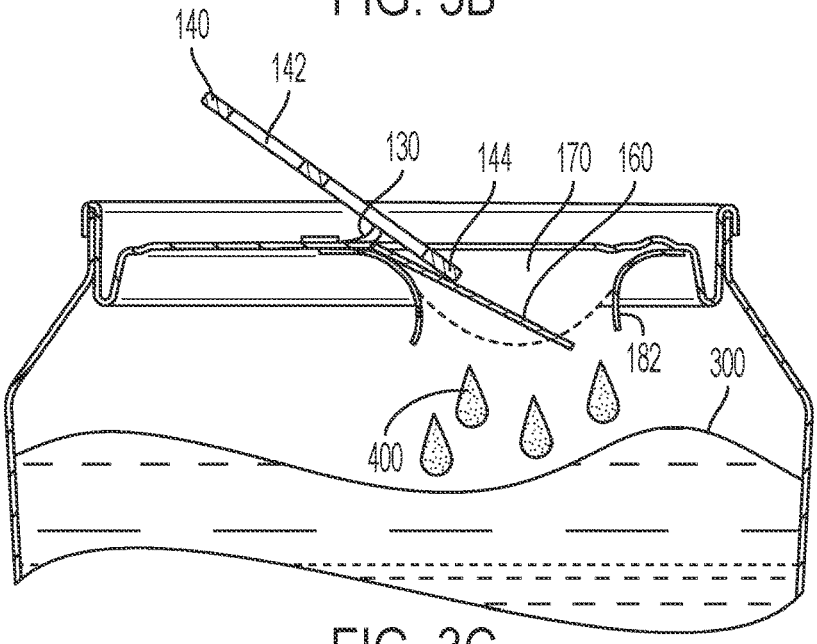

FIGS. 3A-3C show side views of can end 100 with ingredient chamber 180 and illustrate in detail the process of opening ingredient chamber 180 according to one embodiment. Before consumption, a consumer's finger pulls tab 140 at ring 142. Through a traditional stay-on tab lever mechanism, with rivet 130 serving as a fulcrum, tab end 144 exerts a downward force on weakened portion 150, as shown in FIG. 3B. Thereafter, weakened portion 150 breaks away from the rest of metal body 120 along weakened line 152 to create flange 160 and drinking opening 170. Finally, as shown in FIG. 3C, tab end 144 pushes flange 160 further downwards to pierce through and break membrane 182 to release beverage ingredient 400 from ingredient chamber 180.

In order to ensure that flange 160 pierces through and breaks membrane 182 automatically when weakened portion 150 breaks away from metal body 120 to create drinking opening 170 and flange 160, membrane 182 may be disposed across weakened portion 150 and extend beyond weakened line 152. The top view of can end 100 as shown in FIG. 4 illustrates the relative location of each element. Membrane is disposed on underside 124, sealed along a membrane seal line 184 as shown in dotted line. Membrane seal line 184 is located outside weakened line 152, such that weakened portion 150 is enclosed by membrane seal line 184. Therefore, when weakened portion 150 breaks away from metal body 120 by tab end 144 to create flange 160, membrane 182 remains attached to underside 124. Flange 160 then is pushed downwards into ingredient chamber 180 and eventually pierces through and breaks open membrane 182 from the inside of ingredient chamber 180.

FIG. 5 shows another embodiment of ingredient chamber 180, which further includes a top layer 186. Instead of being directly attached to underside 124 of metal body 120, membrane 182 is attached to top layer 186 to create a sealed cavity for storing beverage ingredient 400. Accordingly, ingredient chamber 180 is a self-contained chamber independent from metal body 120 and attachable to underside 124 of metal body 120 through top layer 186. Top layer 186 may be made of a same material as membrane 182 or may be made of a different material from membrane 182. Top layer 186 may be made of a material that allows flange 160 to pierce through. Top layer 186 may be attached to underside 124 at a position such that membrane 182 is at the same relative position to weakened portion 150 and weakened line 152 as shown in FIG. 4.

This embodiment offers minimum disruptions and modifications to traditional can and can end manufacturing processes. Because self-contained ingredient chamber 180 is sealed by membrane 182 and top layer 186, it may be manufactured separately from can end 100 and can body 200 and does not disrupt the established process for either can end manufacturing or can body manufacturing. The only additional step is to attach the self-contained ingredient chamber 180 to underside 124 of metal body 120 after can end 100 has been manufactured and before can end 100 is sealed with can body 200.

Figure 6:
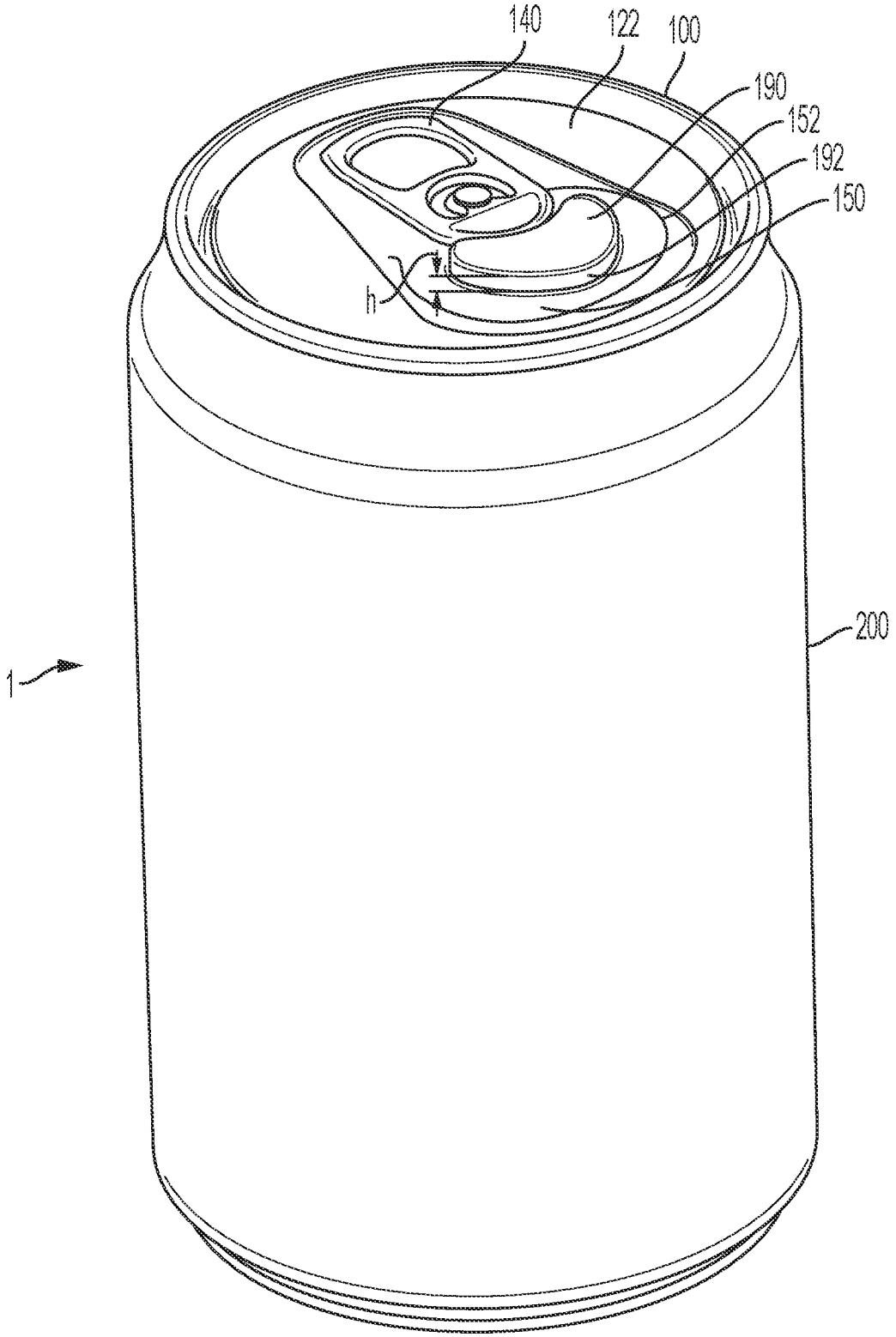
FIG. 6 is a perspective view of a beverage can with a can end having a deformed cavity as an ingredient chamber.
Figure 7:
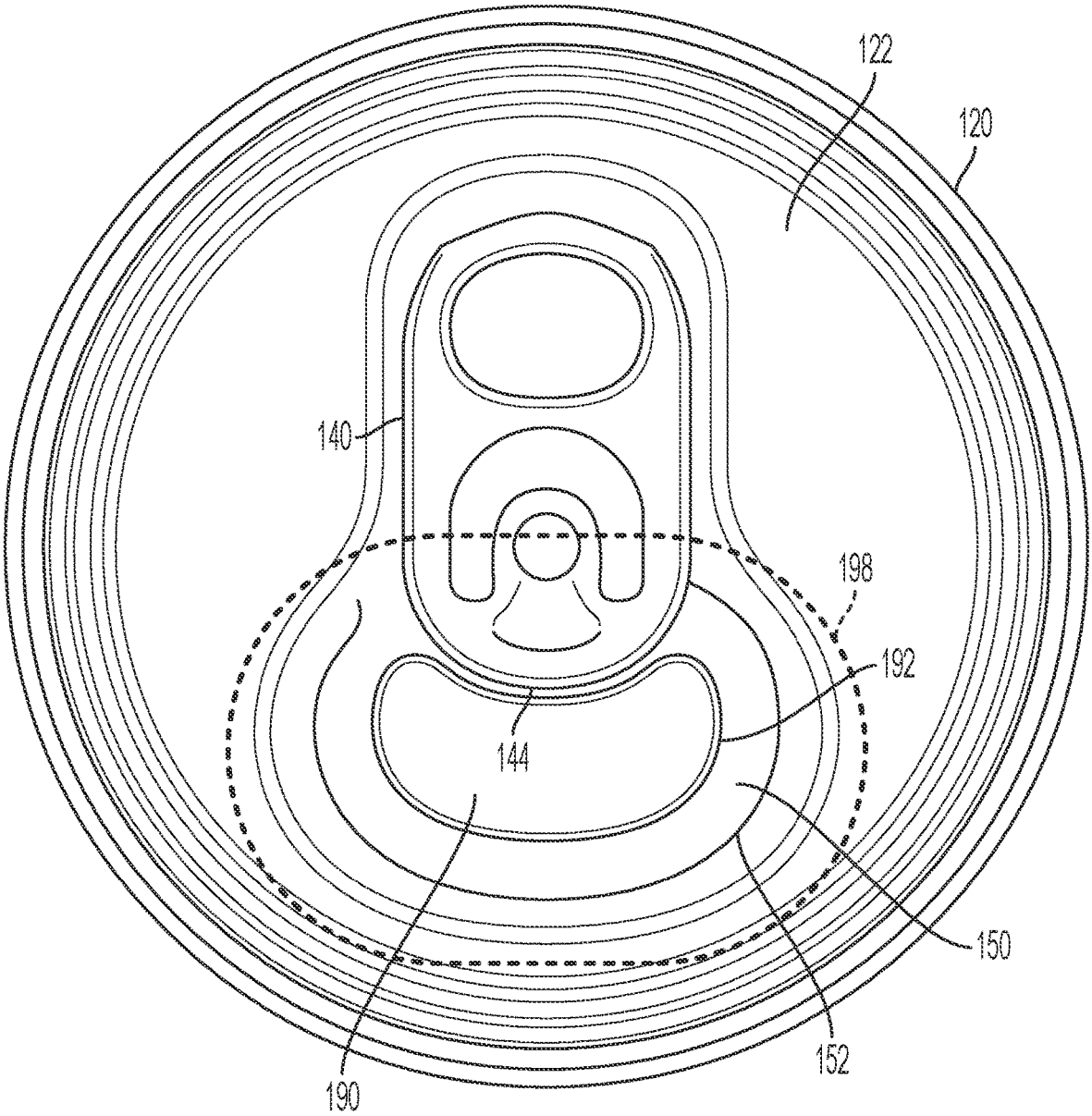
FIG. 7 is a schematic top view of the can end of FIG. 6.

FIG. 6 shows yet another embodiment. Instead of an ingredient chamber created by membrane 182 as shown in FIGS. 1-6, in this embodiment, ingredient chamber 190 is created by a deformed cavity 192 on metal body 120. Deformed cavity 192 may be created, for example, by a punching process from underside 124 of metal body 120. An opening 194 on underside 124, shown in FIG. 8, allows beverage ingredients 400 to be injected into or released from deformed cavity 192. As shown in the top view of FIG. 7, deformed cavity 192 may be located at weakened portion 150 within weakened line 152 and spaced apart from tab end 144. In this way, deformed cavity 192 does not interfere with the lever mechanism for breaking away weakened portion 150 to create drinking opening 170, and deformed cavity 192 also becomes part of flange 160 that bends downwards.

The capacity of deformed cavity 192 is accordingly determined by the size of opening 194 and a height (h) of deformed cavity 192. In some embodiments, height (h) of deformed cavity 192 may be between 1 mm and 2 mm.

Figure 8:
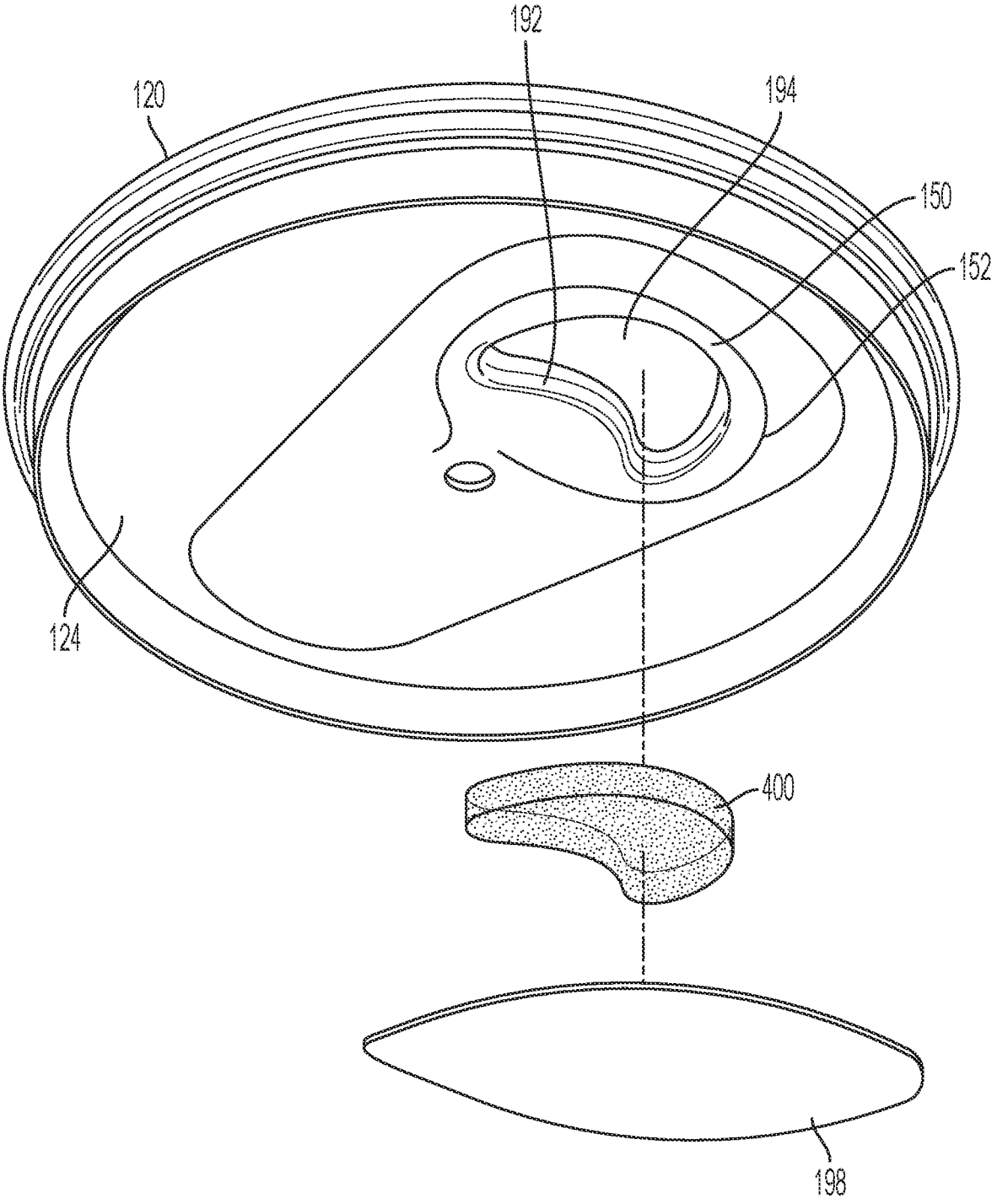
FIG. 8 is an exploded view of the can end of FIG. 6.
Figure 10:
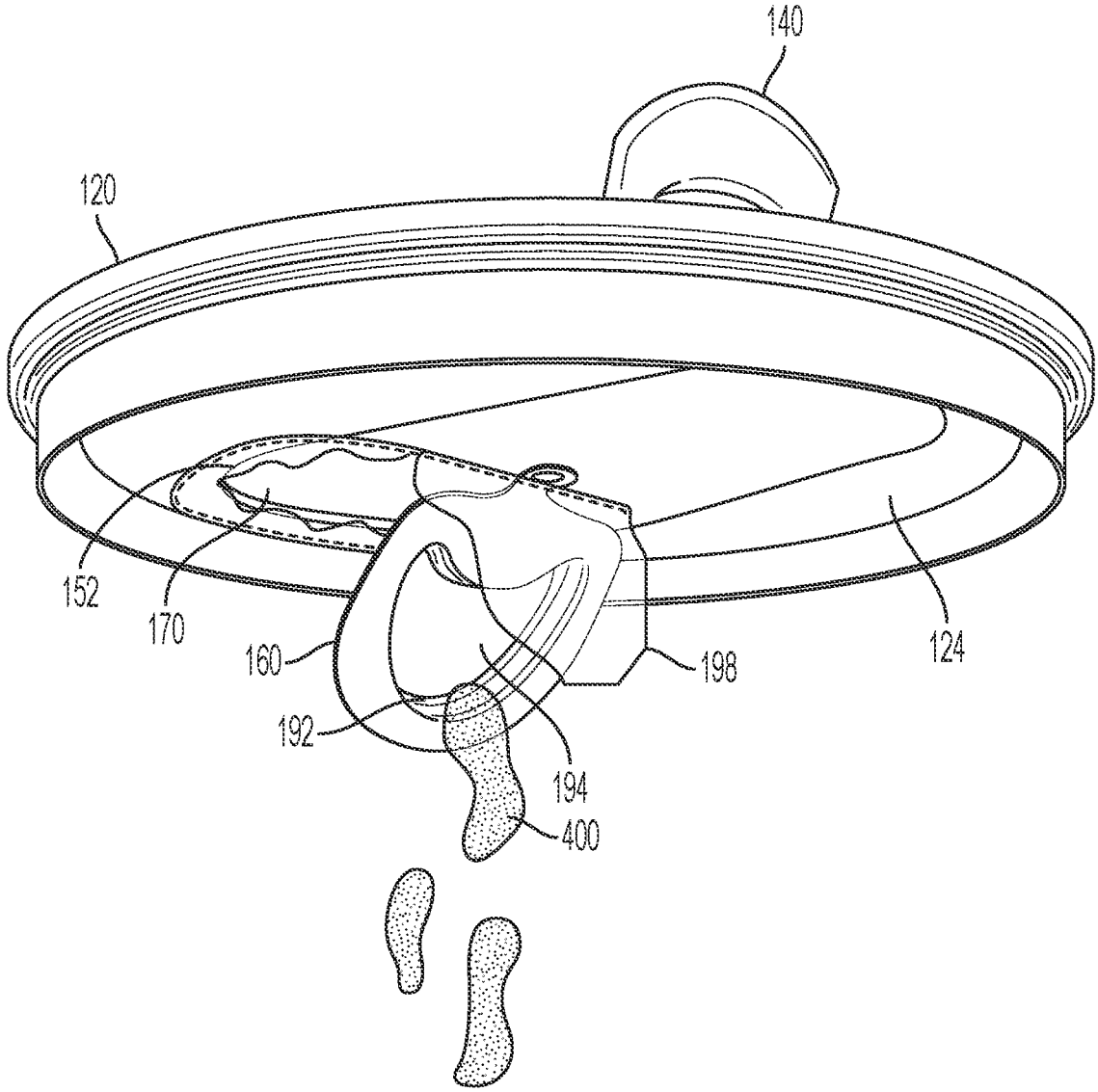
FIG. 10 is a bottom perspective view of the assembled can end of FIG. 6 after opening.

FIG. 8 shows an exploded view of can end 100 and ingredient chamber 190 assembled with beverage ingredient 400. Beverage ingredient 400 is added (e.g. injected) into deformed cavity 192 through opening 194. Beverage ingredient 400 may be in a powder form, a liquid form, or a solid form. When beverage ingredient 400 is in a solid form, it may be made in a shape that conforms to the shape of opening 194. After beverage ingredient 400 is added into deformed cavity 192, a seal 198 is disposed across opening 194 on underside 124 to seal beverage ingredient 400 inside deformed cavity 192. Seal 198 may be attached to underside 124 through an adhesive material. Seal 198 may be made of aluminum foil. Seal 198 may be broken open or detached altogether from underside 124 by flange 160. As shown in FIG. 10, when seal 198 breaks open or detaches from underside 124, beverage ingredient 400 is released from deformed cavity 192 through opening 194.

Figure 9:
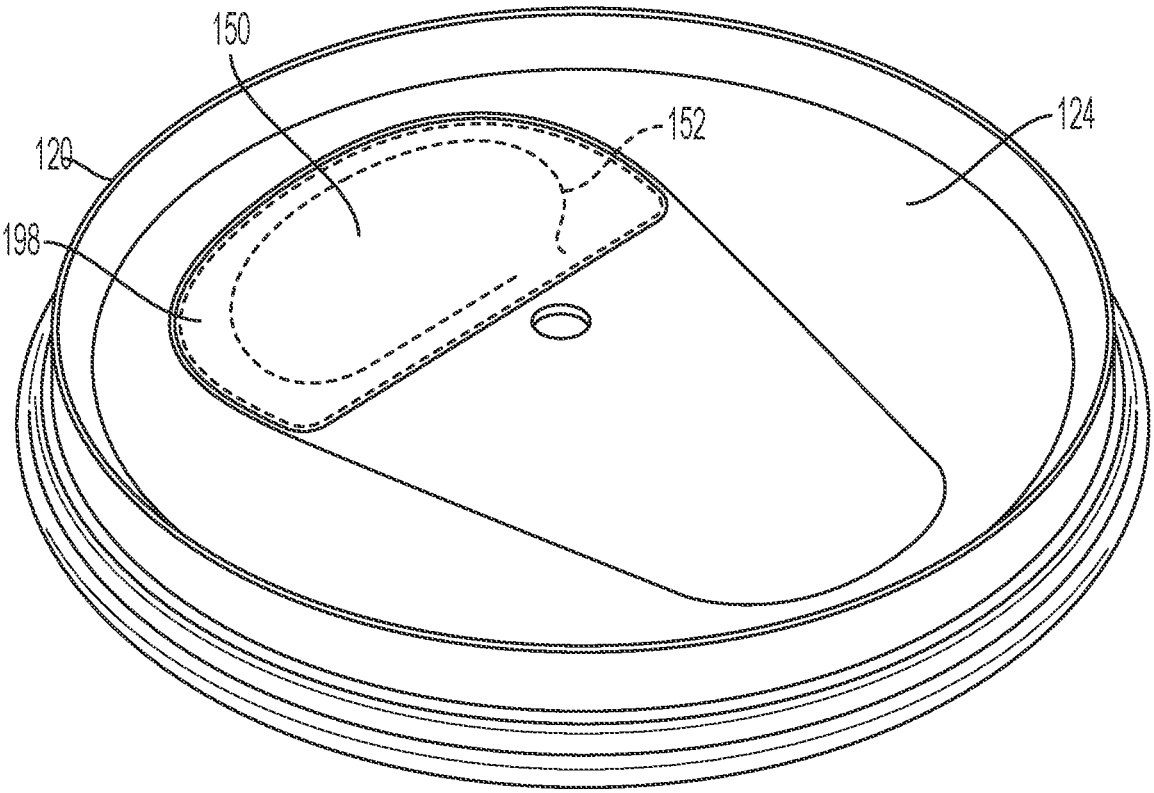
FIG. 9 is a bottom perspective view of the assembled can end of FIG. 6.

In order to ensure that seal 198 breaks open or detaches from underside 124 automatically when weakened portion 150 breaks away from metal body 120 to create flange 160 and drinking opening 170, seal 198 may be extended beyond weakened line 152, as shown in FIG. 9, and attached to underside 124 only on the portion beyond weakened line 152, and preferably only around the perimeter of seal 198. In this way, when weakened portion 150 breaks away from metal body 120, flange 160 is initially enclosed by seal 198, and when flange 160 is pushed further downwards, flange 160 exerts a force on seal 198 to either break it open or detach it from underside 124.

FIG. 10 shows the assembly of FIGS. 8 and 9 after opened by a consumer. After weakened portion 150 breaks away from metal body 120, flange 160, including deformed cavity 192, is pushed downwards and breaks open seal 198. Because seal 198 is not attached to weakened portion 150, it is not attached to flange 160, and it can automatically separate from opening 194 to release beverage ingredient 400 from deformed cavity 192.

Figure 11:
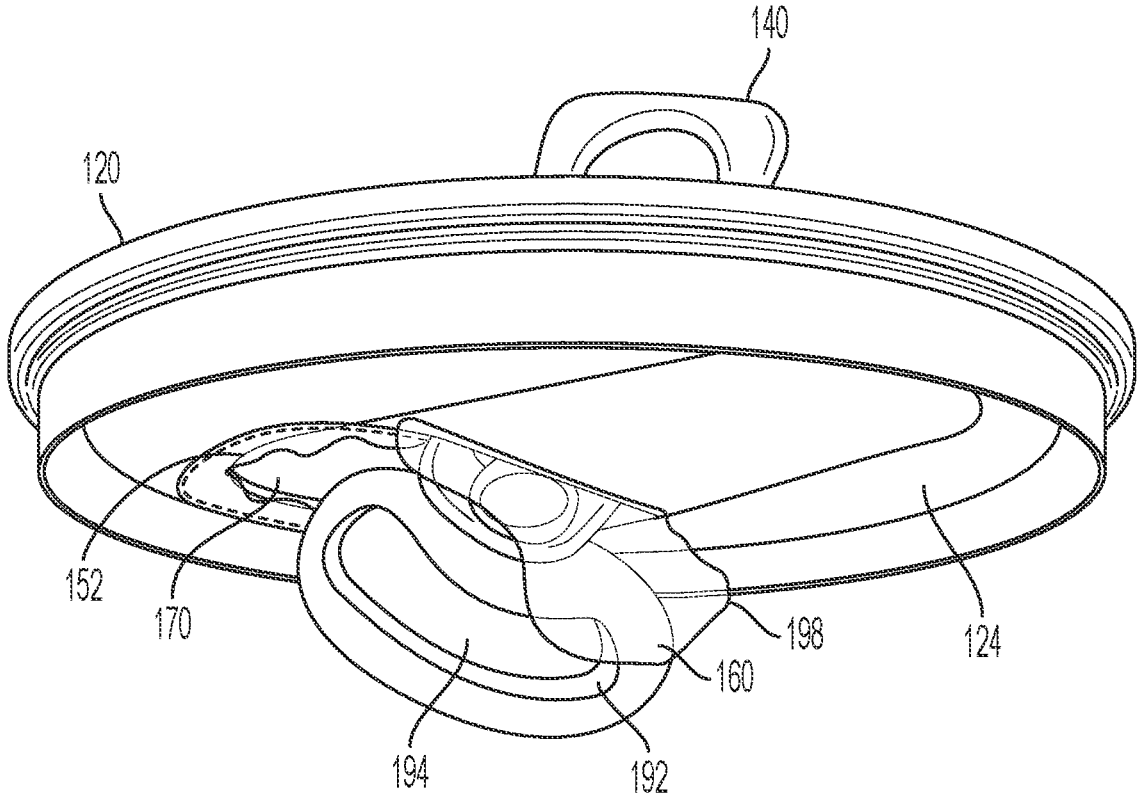
FIG. 11 is a bottom perspective view of the assembled can end of FIG. 6 after opening.

FIG. 11 shows a further embodiment where flange 160 may be rotated by tab 140 after it breaks open seal 198. This allows separating opening 194 further away from seal 198. Because seal 198 may be made of a flexible material, it is possible that seal 198 does not separate from opening 194 by self-weight, or it is possible that pressure from base beverage 300 inhibits seal 198 from separating from opening 194. Accordingly, allowing opening 194 to be rotated away from seal 198 ensures that beverage ingredient 400 can be released from cavity 192 free of seal 198.

Ingredient chamber 190 also provides a benefit in the ease of manufacturing. Deformed cavity 192 may be created through a punching process after can end 100 has been manufactured and before it is sealed with can body 200, in order to minimize disruptions and modifications to traditionally established can manufacturing and can end manufacturing processes.

Figure 12:
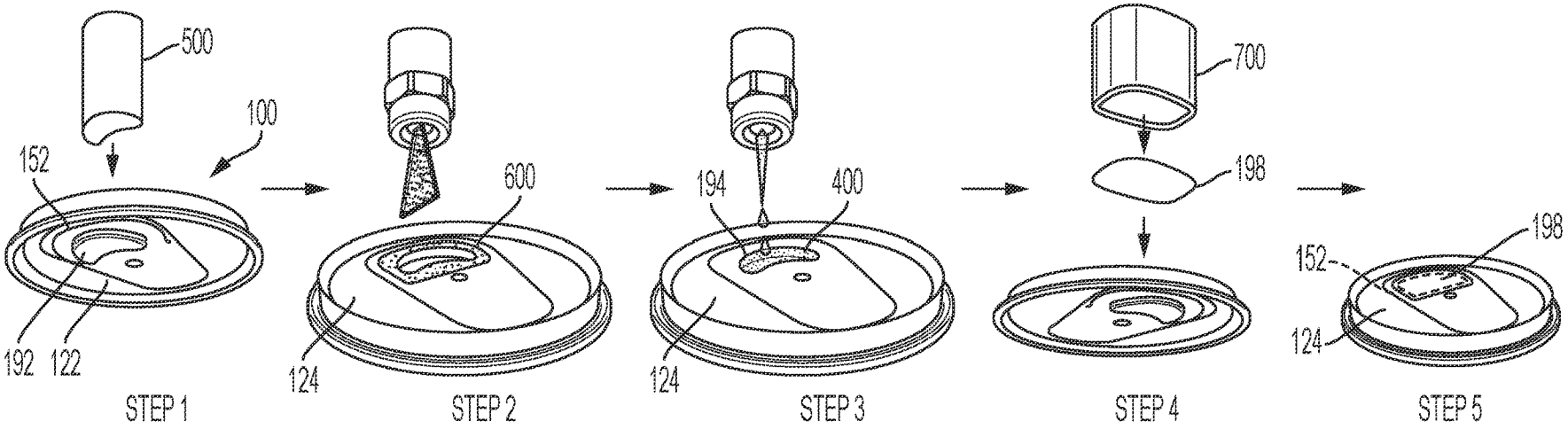
FIG. 12 is a diagram of a manufacturing process of the can end of FIG. 6.

FIG. 12 shows a flow chart of the steps for manufacturing and assembling ingredient chamber 190. At step 1, a punch 500 deforms can end 100 at a location within weakened line 152 to create deformed cavity 192. At step 2, an adhesive PVC layer 600 is applied (e.g. brushed or sprayed) onto underside 124. At step 3, beverage ingredient 400 is added (e.g. injected) into deformed cavity 192. At step 4, heat and pressure 700 is applied on seal 198, preferably around the perimeter of seal 198, allowing seal 198 to adhere to adhesive PVC layer 600. Step 5 shows the fully assembled ingredient chamber 190. Ideally, the perimeter of seal 198 extends beyond weakened line 152.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

What is claimed is:

1. A beverage can end, comprising:

a metal body having a topside and an underside, wherein the metal body has a weakened portion configured to be broken open to create a drinking opening;

a tab on the topside, configured to be actuated to break open the weakened portion; and a sealed membrane forming a self-contained ingredient chamber containing a beverage ingredient, wherein the ingredient chamber is attached to the underside of the metal body, disposed across the weakened portion, wherein the sealed membrane is broken in response to actuation of the tab to break the weakened portion, such that the beverage ingredient is released from the sealed membrane.

2. The beverage can end of claim 1, wherein the actuation of the tab breaks the weakened portion to create a flange and forces the flange through the sealed membrane, such that the beverage ingredient is released from the sealed membrane.

3. The beverage can end of claim 1, wherein the sealed membrane is attached to the underside of the metal body by an adhesive.

4. The beverage can end of claim 1, wherein the sealed membrane comprises a top portion disposed on the underside of the metal body and a bottom portion, and wherein the top portion and the bottom portion together define a sealed cavity containing the beverage ingredient.

5. The beverage can end of claim 1, wherein the ingredient chamber has a size between 0.1 cc to 65 cc.

6. The beverage can end of claim 1, wherein the beverage ingredient has a functional property that degrades in an acidic environment.

7. A beverage can comprising the beverage can end of claim 1.

8. The beverage can of claim 7, further comprising a beverage can body to which the beverage can end is attached, wherein the ingredient chamber is not in contact with the beverage can body.

9. The beverage can of claim 7, further comprising:

a base beverage sealed within the can; and a beverage ingredient sealed within the ingredient chamber, wherein the base beverage and the beverage ingredient are separated by the sealed membrane while the can remains closed.

10. The beverage can of claim 9, wherein opening the can breaks the sealed membrane and causes the beverage ingredient to be released into the base beverage.

11. A beverage can end, comprising:

a metal body having a topside and a underside, wherein the metal body has a break-away flange that creates a drinking opening through the metal body when the break-away flange is broken away from the rest of the metal body, and wherein the metal body defines a cavity with an opening on the underside, the cavity configured to store a beverage ingredient; and a tab on the topside, configured to be actuated to apply force to the break-away flange to break the break-away flange away from the rest of the metal body.

12. The beverage can end of claim 11, wherein the cavity is part of the flange and defined within a perimeter of the flange.

13. The beverage can end of claim 11, wherein the cavity has a height between 1 mm and 2 mm.

14. The beverage can end of claim 11, further comprising a seal attached to the underside covering the opening of the cavity.

15. The beverage can end of claim 14, wherein the seal is formed of aluminum foil.

16. The beverage can end of claim 14, wherein the seal extends across an interface between the flange and the rest of the metal body, such that when the flange is broken away from the rest of the metal body to create the drinking opening, the seal is either broken apart or at least partially detached from the underside to release the beverage ingredient from the cavity.

17. The beverage can end of claim 16, wherein the tab is configured to twist the flange after the flange is broken away from the rest of the metal body to create the drinking opening.

18. The beverage can end of claim 11, wherein the beverage ingredient has a functional property that is diminished in an acidic environment.

19. A beverage can comprising the beverage can end of claim 14.

20. The beverage can of claim 19, further comprising:

a base beverage sealed within the can; and a beverage ingredient sealed within the cavity of the flange, wherein the base beverage and the beverage ingredient are separated by the seal while the can remains closed.

21. The beverage can of claim 20, wherein opening the can breaks the seal and causes the beverage ingredient to be released into the base beverage.

22. The beverage can end of claim 11, wherein the flange is deformed to form the cavity.

* * * * *